US008171675B2

(12) United States Patent
Chapus

(10) Patent No.: US 8,171,675 B2
(45) Date of Patent: May 8, 2012

(54) ROOFING ELEMENT SUCH AS THE ONE USED IN PARTICULAR AS SWIMMING POOL LOW-SHELTER COMPONENT

(75) Inventor: Charles Chapus, Aurade (FR)

(73) Assignee: Abrisud, L'Isle Jourdain (FR)

( * ) Notice: Subject to any disclaimer, the term of this patent is extended or adjusted under 35 U.S.C. 154(b) by 123 days.

(21) Appl. No.: 12/293,729

(22) PCT Filed: Mar. 20, 2007

(86) PCT No.: PCT/FR2007/050960

§ 371 (c)(1),
(2), (4) Date: Nov. 2, 2008

(87) PCT Pub. No.: WO2007/107671

PCT Pub. Date: Sep. 27, 2007

(65) Prior Publication Data

US 2010/0199575 A1 Aug. 12, 2010

(30) Foreign Application Priority Data

Mar. 21, 2006 (FR) ..... 06 50972

(51) Int. Cl.
*E04B 1/346* (2006.01)

(52) U.S. Cl. ..... 52/64; 52/200; 52/222; 160/376

(58) Field of Classification Search ..... 52/64, 200, 52/222, 273; 160/352, 372, 373, 375, 376, 160/378

See application file for complete search history.

(56) References Cited

U.S. PATENT DOCUMENTS 2,827,138 A * 3/1958 Roy, Jr. ..... 52/86
3,661,195 A * 5/1972 Fischer ..... 160/373
4,214,411 A * 7/1980 Pickett ..... 52/144
(Continued)

FOREIGN PATENT DOCUMENTS

BE 883 517 A1 9/1980
(Continued)

OTHER PUBLICATIONS

International Search Report, Sep. 17, 2007, from International Phase of the instant application.
English Translation of the Written Opinion of the International Search Authority, Oct. 21, 2008, from International Phase of the instant application.
English Translation of International Preliminary Report on Patentability Chapter I, Oct. 21, 2008, from International Phase of the instant application.

*Primary Examiner* — Brian Glessner
*Assistant Examiner* — Adriana Figueroa
(74) *Attorney, Agent, or Firm* — Jackson Patent Law Office

(57) ABSTRACT

The invention concerns a roofing element (E) of the type of the one consisting of a material board (100) maintained inside a frame (200), characterized in that it consists of a single-walled solid material board and of at least one tensioning means (300) linked to the frame (200) tending to space apart certain parts constituting the frame (200) so as to stress said board (100), the frame consisting of two transverse profiled sections (210 and 220) fixed to two opposite sides of the board (100), the tensioning means (300) tending to space apart said profiled sections (210 and 220), the edges of the board (100) subjected to a tensile stress and slid into the profiled sections being provided with at least one projection (110) facilitating the transmission of said stress, the profiled section being itself preformed to retain said projection in the direction of the tensile stress. The invention is applicable to swimming pool low shelter, veranda and the like.

10 Claims, 3 Drawing Sheets

U.S. PATENT DOCUMENTS

| | | | | |
|---|---|---|---|---|
| 4,233,790 | A * | 11/1980 | Meadows | 52/222 |
| 4,453,585 | A * | 6/1984 | Ruggeberg et al. | 160/354 |
| 5,271,171 | A * | 12/1993 | Smith | 38/102.5 |
| 5,333,425 | A * | 8/1994 | Nickerson et al. | 52/222 |
| 5,531,258 | A * | 7/1996 | Poulson et al. | 160/376 |
| 6,886,300 | B2 * | 5/2005 | Hudoba et al. | 52/222 |
| 6,959,748 | B2 * | 11/2005 | Hudoba | 160/31 |
| 7,007,735 | B1 * | 3/2006 | Lake | 160/374.1 |
| 7,263,805 | B2 * | 9/2007 | Chapus | 52/67 |
| 2002/0017369 | A1 | 2/2002 | Peppett | |
| 2005/0139334 | A1 * | 6/2005 | Bernardi | 160/378 |

FOREIGN PATENT DOCUMENTS

| | | | |
|---|---|---|---|
| EP | 1 239 066 | A | 9/2002 |
| FR | 2 776 000 | A1 | 9/1999 |

* cited by examiner

ROOFING ELEMENT SUCH AS THE ONE USED IN PARTICULAR AS SWIMMING POOL LOW-SHELTER COMPONENT

FIELD OF APPLICATION OF THE INVENTION

This invention relates to the field of roofing elements such as those used in low swimming pool shelters and in particular to the adaptations making it possible to improve the transparency and reduce the weight thereof.

DESCRIPTION OF THE PRIOR ART

The roofing elements can be those proposed in document FR 2776000, which describes a swimming pool roofing element structure of the type composed of a cover formed by panels made of a translucent material such as double-wall polycarbonate and a rigid, lightweight and resistant reinforcement for supporting the transparent cover, which reinforcement is formed by arcs arranged in transverse planes and spaced apart by cross-members with two outermost lateral cross-members delimiting two edges of the roofing element. These two lateral edges rest on the longitudinal edges of the basin defining a contact surface with said roofing elements.

These roofing elements have the disadvantage of using double-wall alveolar polycarbonate for the translucent panel.

This alveolar polycarbonate is expensive and does not provide the best possible transparency since it is formed by at least two sheets connected to one another by partitions.

Moreover, the thickness of such an alveolar material defines a bulk that must be dealt with when transporting said panels.

The prior art discloses more transparent, non-alveolar materials, but their use presents other problems, for example:

- a sheet of solid material of lower thickness is too flexible,
- a sheet of solid material with the same rigidity as the alveolar material is too heavy.

Another problem encountered in the exterior use of large panels of a solid material sheet involves the variation of the dimensions to which it can be subjected due to the variation in temperatures.

DESCRIPTION OF THE INVENTION

On the basis of the above, the applicant has conducted research to find an alternative to the use of alveolar panels in roofing elements.

This research has resulted in a technical solution making it possible to use panels of more flexible material with a lower thickness, overcoming the disadvantages mentioned above.

According to the main feature of the invention, the roofing element of the type consisting of a panel of material held inside of a frame is remarkable in that it is composed of a panel made of a single-wall solid material and at least one tensioning means linked to the frame tending to separate certain parts constituting the frame so as to apply tension to said panel, the frame is composed of two transverse profiles attached to two opposite sides of the panel, with the tensioning means tending to separate said profiles, the edges of the panel subjected to a pulling force and slid into the profiles are equipped with at least one projection facilitating the transmission of this force, with the profile being itself preformed in order to retain this projection in the direction of the pulling force.

This feature is particularly advantageous in that it makes it possible to use a single-wall panel in spite of its lack of rigidity. It is thus possible to use any material capable of being placed in a frame and capable of supporting the pulling force to which it will be subjected. The tensioning of the panel makes it possible to prevent it from collapsing in the event of dilation due to climatic conditions.

This feature therefore ensures a panel that perfectly matches the general shape of the frame in spite of its flexibility.

This feature is possible whether the panel is transparent or not. Indeed, the feature allows the use of perfectly transparent single-wall non-alveolar panels. The transparency of the material used for the panel makes it possible to see through and offers the possibility of seeing inside the basin protected by the roofing, which is particularly secure. This security functionality could not be implemented in the panels of the prior art, which were alveolar and which could not be considered to be translucent.

The use of a single-wall panel reduces the weight of the structure and requires less bulk for storage or transport.

Thus a special feature of the invention is the association, with the frame or with the reinforcement supporting the flexible and transparent panel, tensioning means tending to separate certain parts forming the frame in order to maintain the tension of said panel.

According to another particularly advantageous feature of the invention, this roofing element consists of two transverse profiles attached to two opposite sides of the panel and connected to one another by cross-members of which at least one comprises tensioning means tending to separate said profiles. The tensioning can be performed for each element ensuring the connection between the two profiles, i.e. for each cross-member.

In the case of a low swimming pool shelter, the profiles into which the panels slide are conventionally arched and form arcs of which each end rests on the edge of the basin. In addition, the two outermost lateral cross-members, which delimit two edges of the roofing element and which rest on the longitudinal edges of the basin, define a contact surface with said roofing elements.

To transmit and control the pulling force, the edges of the panel subjected to a pulling force, slid into the profiles, are equipped with at least one projection facilitating the transmission of this force. The profile is itself preformed to retain said projection in the direction of the pulling force.

These tensioning means can be implemented in a plurality of embodiments.

A first embodiment proposes that at least one end of a cross-member slide transversely with respect to the profile and comprise at least one tensioning means composed of a casing housing a spring that comes into contact with said profile, thus tending to separate the cross-member from the profile.

A second embodiment proposes that the cross-member equipped with tensioning means consist of two parts capable of being moved one with respect to the other and connected to one another by a sliding connection controlled by a spring.

According to a preferred technological choice, the material of the single-wall panel is polycarbonate.

The fundamental concepts of the invention having been described above in their most basic form, other details and features will become clearer on reading the following description and in view of the appended drawings, provided for non-limiting purposes, of an embodiment of a roofing element according to the invention.

DESCRIPTION OF THE PREFERRED EMBODIMENTS

Figure 1:
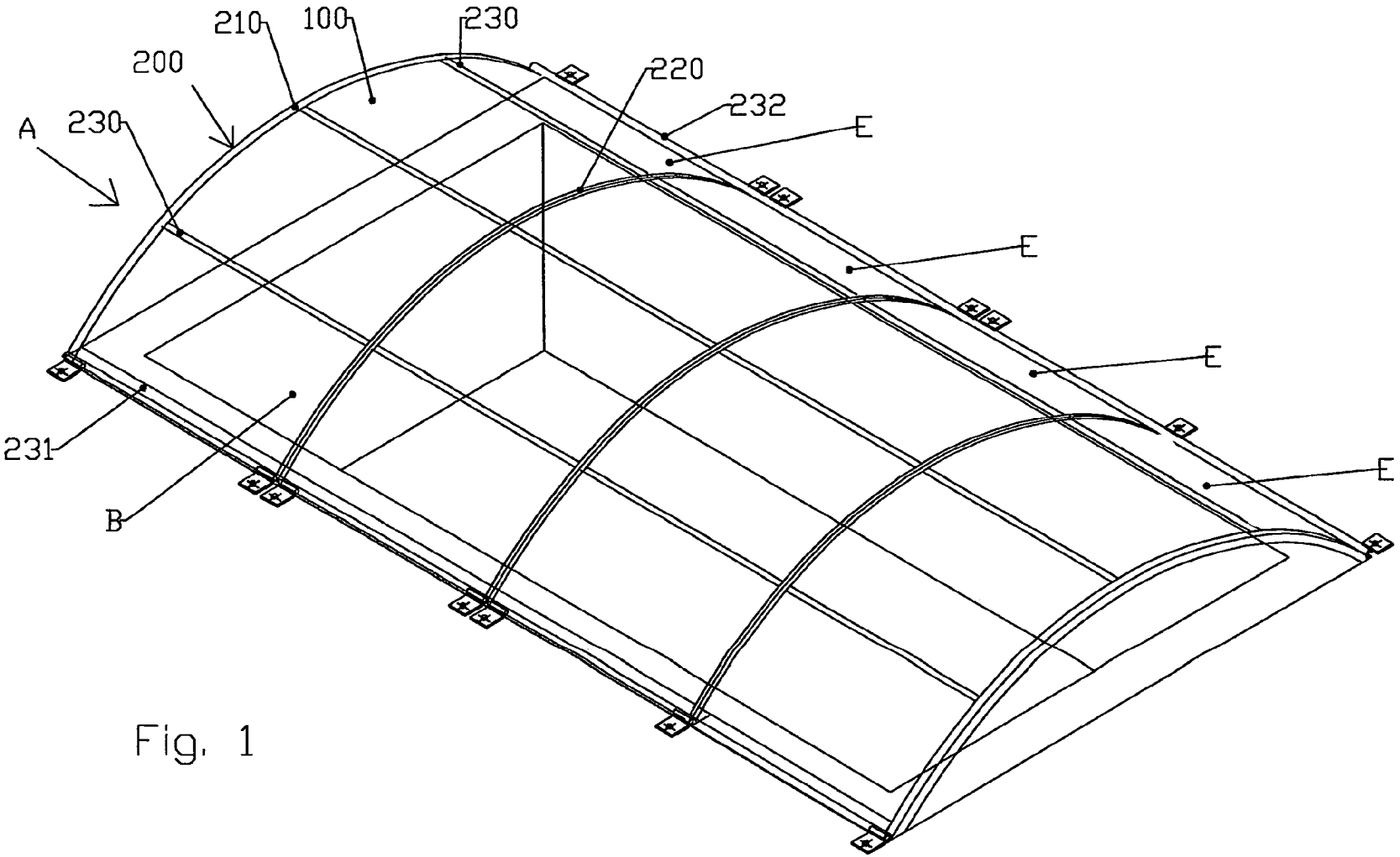
FIG. 1 is a diagrammatic drawing of a perspective view of an embodiment of a low swimming pool shelter composed of roofing elements according to the invention.

The drawing of FIG. 1 shows an embodiment of a low swimming pool shelter referenced A in its entirety ensuring the coverage of a basin referenced B. This low shelter includes a plurality of roofing elements E.

Each roofing element E is composed of a panel of material 100 held inside a frame 200. This frame 200 is composed of two transverse arched profiles 210 and 220 connected to one another by the panel 100 and by cross-members 230 arranged under the panel 100. Two outermost lateral cross-members 231 and 232 delimit two edges of the roofing element E. These two lateral edges rest on the longitudinal edges of the basin B defining a contact surface with said roofing elements E.

The edges of the panel 100 slide into the arched profiles 210 and 220 of the frame 200 and cause the panel 100 to adopt the curvature of said profiles. The cross-members ensure the spacing of said profiles in order to ensure the rigidity thereof.

According to the invention, the roofing element E includes a panel 100 made of a single-wall solid material and tensioning means connected to the frame tending to apply tension to said panel 100, which is flexible due to its thickness and size.

According to a preferred embodiment and according to the invention, the material used is transparent. According to a preferred technological choice, this material is transparent polycarbonate. This polycarbonate is associated with an aluminium frame. The polycarbonate is in the form of a sheet with a thickness of between 1.4 and 2 millimetres, which enables the deformation of its edges, and which provides flexibility enabling it to follow the curvature of the transverse arcs, but which causes a longitudinal bending that must be solved by tensioning means.

According to the invention, at least one cross-member 230 comprises tensioning means tending to separate said profiles 210 and 220, which hold the edges of the panel 100, and therefore tension said panel 100.

Figures 2, 2A:
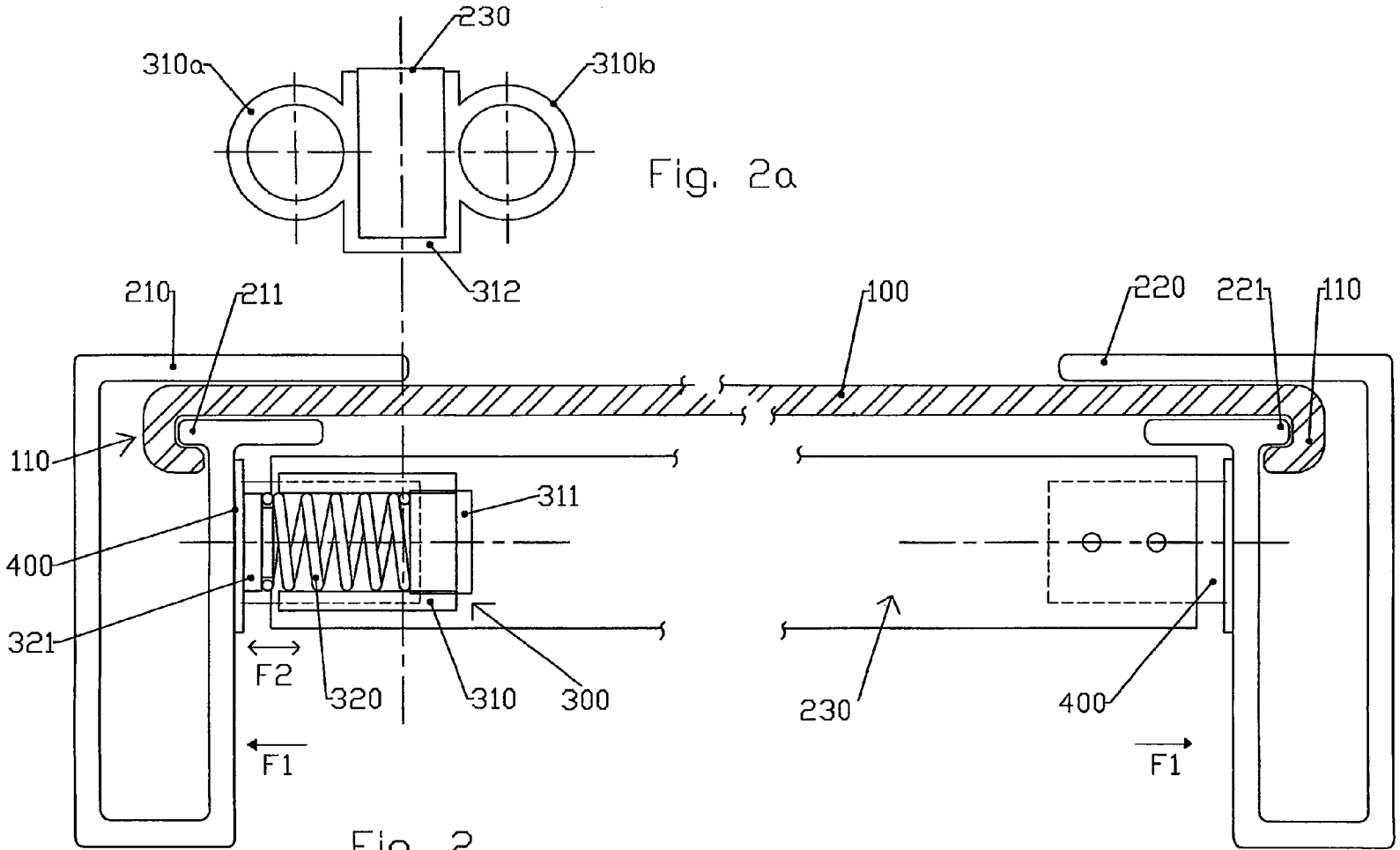
FIG. 2 is a diagrammatic drawing of a partial cross-section view of a roofing element using a first embodiment of the tensioning means.
FIG. 2*a* is a diagrammatic drawing of a cross-section of a detail of said tensioning means.
Figure 3:
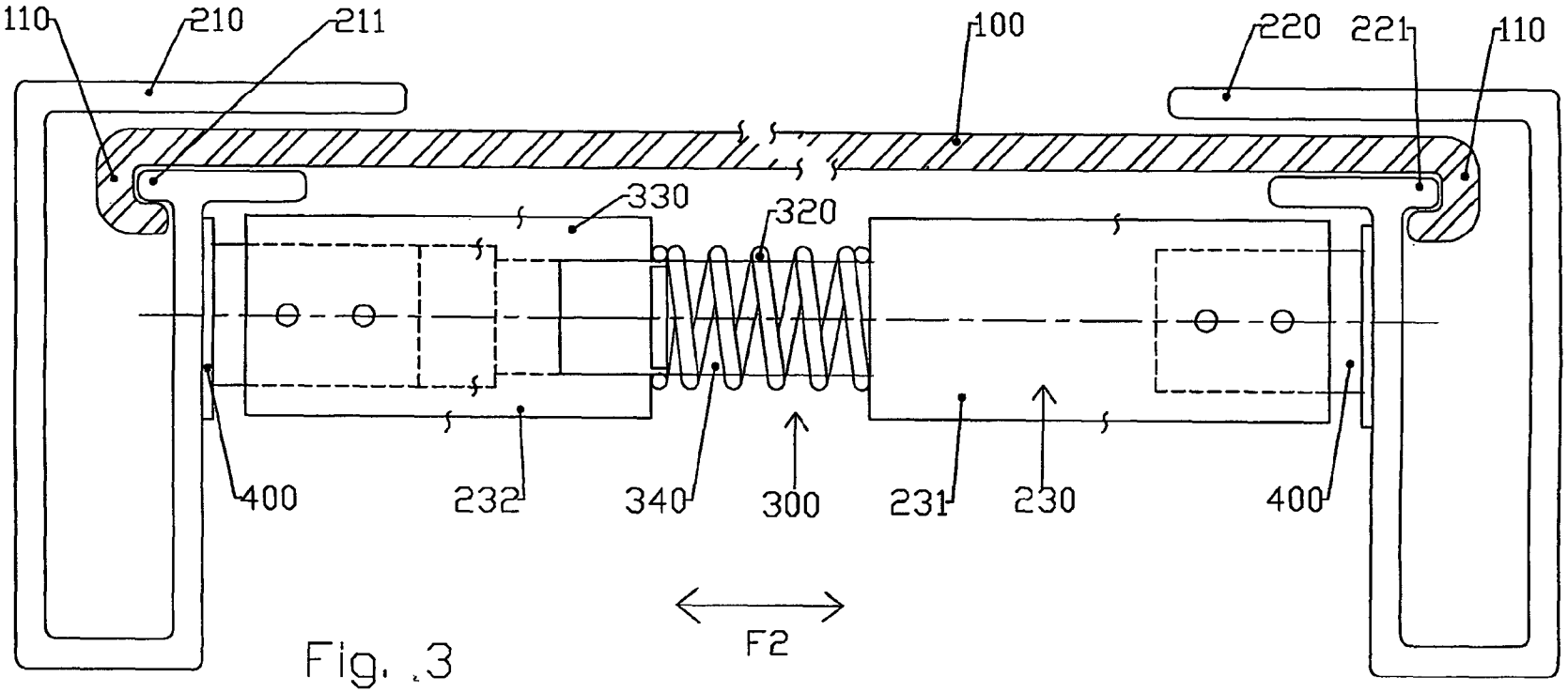
FIG. 3 is a diagrammatic drawing of a partial cross-section view of a roofing element using a second embodiment of the tensioning means.

According to the embodiment shown in the drawings of FIGS. 2 and 3, the edges of the panel 100 according to the arrows F1 subjected to a pulling force are equipped with at least one projection facilitating the transmission of this force. More specifically, each panel edge is preformed in order to have a C-shaped edge, which is positioned in the profile 210 and 220 so that its branches come from each side of a lug 211 and 221 provided for this purpose in the profiles 210 and 220. Thus, once the panel 100 has slid into the profiles, said panel 100 cannot be released from said profiles 210 and 220 in a longitudinal translation movement, i.e. in the direction of the pulling force. The cooperation between this return 110 and the lugs 210 and 220 provided inside the profiles 100 ensures successful transmission of the pulling force exerted by the tensioning means 300.

According to the embodiment shown in the drawing of FIG. 2, at least one end of a cross-member 230 slides transversely according to the double arrow F2 with respect to one of the profiles 210 and comprises at least one tensioning means 300 composed of a casing 310 housing a spring 320, which comes into contact with said profile 210, thus tending to separate the cross-member 230 from the profile 210.

More specifically, and according to the invention, said casing 310 adopts the shape of a cylindrical tube, which is attached to the cross-member 230 and at a first end of which a stop 311 is provided, with which the spring 320 comes into contact, and the other end of which is open to enable the spring 320 to come into contact with said profile. According to a particularly advantageous feature, the position of the stop 311 can be adjusted inside the casing 310 so as to ensure the adjustment of the force exerted by the spring. According to a preferred embodiment, said stop 311 is threaded and is connected in a screw-type manner to the casing 310 so as to move axially inside it. The end of the spring 320 that comes into contact with the profile 210 or 220 is associated with a stop 321.

According to a preferred embodiment, each cross-member includes means for tensioning the frame. According to a preferred technological choice, the two outermost lateral cross-members 231 and 232 forming edges are equipped with tensioning means 300 and the cross-members 230 between the two outermost cross-members are equipped with two tensioning means 300.

An embodiment of the attachment of the two tensioning means at the end of a cross-member 230 is shown in the drawing of FIG. 2*a*. In this embodiment, two tubular casings 210*a* and 310*b* are arranged on each side of the cross-member 230 by being associated with a profile 312 internally including the external profile of the cross-member 230 for its positioning and attachment to the latter. According to a preferred embodiment, the cross-members 230 have a rectangular profile and are slidingly connected at a first end and stationarily connected at the other end to the transverse profiles 210 and 220, by means of T-shaped parts 400 provided for this purpose.

According to another embodiment shown in the drawing of FIG. 3, the cross-member 230 equipped with tensioning means 300 consists of two parts 231 and 232 capable of moving according to the double arrow F2, one with respect to the other, and connected to one another by a sliding connection controlled by a spring forming the tensioning means 300.

The two ends of the cross-member are then stationarily connected to the transverse profiles 210 and 220.

More specifically, said tensioning means 300 consist of a female element 330 associated with a first part 232 of a cross-member 230 cooperating with a male element 340 associated with a second part 231 of the cross-member 230.

It is understood that the roofing element has been described and shown above for the purpose of disclosure rather than as a limitation. Of course, various arrangements, modifications and improvements can be made to the example above without going beyond the scope of the invention.

The invention claimed is:

1. A roofing assembly comprising:

a panel made of a single-wall solid polycarbonate material, the panel defining a first end and a second end opposite the first end, the panel including a first projection at the first end and a second projection at the second end;

a frame including a first transverse profile attached to the first end of the panel, the first transverse profile being preformed to retain the first projection of the panel, and a second transverse profile attached to the second end of the panel, the second transverse profile being preformed to retain the second projection of the panel, wherein the roofing assembly further includes a force-applicator, located between the first transverse profile and the second transverse profile, the force-applicator being configured to apply a force between the first transverse profile and the second transverse profile, thereby applying a tension force to the panel, the force-applicator defining a longitudinal axis displaced from the panel, the force-applicator including two parts capable of being moved, one with respect to the other, connected to one another by a sliding connection controlled by a spring.

2. A roofing assembly according to claim 1, characterized in that the material used for the panel is transparent.

3. A roofing assembly according to claim 1, further comprising a second force-applicator configured to apply a second force between the first transverse profile and the second transverse profile.

4. A roofing assembly according to claim 1, wherein the first projection is C-shaped.

5. A roofing assembly according to claim 1, characterized in that the force-applicator includes a female element cooperating with a male element.

6. A roofing assembly according to claim 1, characterized in that the force-applicator includes a cross-member configured to slide transversely with respect to the first and second transverse profiles, the cross member including a casing housing a spring.

7. A roofing assembly according to claim 6, characterized in that said casing adopts the shape of a cylindrical tube.

8. A roofing assembly according to claim 1 further including a second panel made of the single-wall solid material, the second panel being configured to slide into the first and second profiles.

9. A roofing assembly according to claim 1 wherein the force-applicator includes a spring.

10. A roofing assembly comprising:

a panel made of a single-wall solid polycarbonate material, the panel defining a first end and a second end opposite the first end, the panel including a first projection at the first end and a second projection at the second end;

a frame including a first transverse profile attached to the first end of the panel, the first transverse profile being preformed to retain the first projection of the panel, and a second transverse profile attached to the second end of the panel, the second transverse profile being preformed to retain the second projection of the panel, wherein the roofing assembly further includes a force-applicator, located between the first transverse profile and the second transverse profile, the force-applicator being configured to apply a force between the first transverse profile and the second transverse profile, thereby applying a tension force to the panel, the force-applicator defining a longitudinal axis displaced from the panel;

a cross-member attached to the force-applicator; and a second force-applicator attached to the cross-member.

* * * * *